US010262827B2

(12) United States Patent
Jiang et al.

(10) Patent No.: US 10,262,827 B2
(45) Date of Patent: Apr. 16, 2019

(54) FAULT STATE INDICATION DEVICE FOR CIRCUIT BREAKER

(71) Applicants: SEARI ELECTRIC TECHNOLOGY CO., LTD., Shanghai (CN); SHANGHAI NOARK ELECTRIC CO., LTD., Shanghai (CN); ZHEJIANG CHINT ELECTRICS CO., LTD., Yueqing (CN)

(72) Inventors: Xiaofeng Jiang, Shanghai (CN); Jiqing Hu, Shanghai (CN); Peng Chen, Shanghai (CN); Dapeng Li, Shanghai (CN)

(73) Assignees: SEARI ELECTRIC TECHNOLOGY CO., LTD., Shanghai (CN); SHANGHAI NOARK ELECTRIC CO., LTD., Shanghai (CN); ZHEJIANG CHINT ELECTRICS CO., LTD., Yueqing (CN)

( * ) Notice: Subject to any disclaimer, the term of this patent is extended or adjusted under 35 U.S.C. 154(b) by 0 days.

(21) Appl. No.: 15/748,075

(22) PCT Filed: Jun. 29, 2016

(86) PCT No.: PCT/CN2016/087556
§ 371 (c)(1),
(2) Date: Jan. 26, 2018

(87) PCT Pub. No.: WO2017/016364
PCT Pub. Date: Feb. 2, 2017

(65) Prior Publication Data

US 2018/0233315 A1 Aug. 16, 2018

(30) Foreign Application Priority Data

Jul. 28, 2015 (CN) ..... 2015 1 0451567

(51) Int. Cl.
*H01H 71/04* (2006.01)
*H01H 71/08* (2006.01)

(52) U.S. Cl.
CPC ..... *H01H 71/04* (2013.01); *H01H 71/082* (2013.01); *H01H 2071/042* (2013.01);
(Continued)

(58) Field of Classification Search
CPC ..... H01H 71/04; H01H 2071/042; H01H 2221/024; H01H 2221/046;
(Continued)

(56) References Cited

U.S. PATENT DOCUMENTS 3,257,523 A * 6/1966 Clarke ..... H01H 71/50 200/529
4,794,356 A * 12/1988 Yu ..... H01H 71/465 200/331
(Continued)

FOREIGN PATENT DOCUMENTS

CN 1127927 A 7/1996
CN 2911947 Y 6/2007
(Continued)

OTHER PUBLICATIONS

International Search Report issued in corresponding application No. PCT/CN2016/087556 dated Sep. 14, 2016 (4 pages).
(Continued)

*Primary Examiner* — Edwin A. Leon
(74) *Attorney, Agent, or Firm* — Osha Liang LLP

(57) ABSTRACT

A fault state indication device for a circuit breaker includes: a contact group; and a transmission assembly and an indication assembly that are mounted inside a housing. The contact group implements a normally open contact group and a normally closed contact group. The transmission assembly acts on a contact support, different open and closed
(Continued)

states of the contact group are realized via the contact support. The indication assembly indicates a fault state, the indication assembly is linked with the circuit breaker, and carries out a corresponding state indication in response to a fault.

7 Claims, 3 Drawing Sheets

(52) U.S. Cl.
CPC . *H01H 2221/024* (2013.01); *H01H 2221/046* (2013.01); *H01H 2225/014* (2013.01)

(58) Field of Classification Search
CPC ..... H01H 2225/014; H01H 11/0006; H01H 71/0228; H01H 71/50
USPC ..... 200/290, 330
See application file for complete search history.

(56) References Cited

U.S. PATENT DOCUMENTS 4,894,631 A * 1/1990 Castonguay ..... H01H 83/20 335/167
5,793,026 A * 8/1998 Kolberg ..... H01H 71/7463 335/172
2002/0153238 A1 10/2002 Baldauf et al.

FOREIGN PATENT DOCUMENTS

| | | | |
|---|---|---|---|
| CN | 201918327 | U | 8/2011 |
| CN | 103915297 | A | 7/2014 |
| CN | 203690221 | U | 7/2014 |
| CN | 203983200 | U | 12/2014 |
| CN | 105070600 | A | 11/2015 |
| CN | 205104451 | U | 3/2016 |

OTHER PUBLICATIONS

Written Opinion of the International Searching Authority issued in corresponding application No. PCT/CN2016/087556 dated Sep. 14, 2016 (4 pages).
First Office Action issued in application No. CN201510451567.5 with a Search Report and English translation of Search Report, dated Oct. 17, 2016 (7 pages).

* cited by examiner

FAULT STATE INDICATION DEVICE FOR CIRCUIT BREAKER

BACKGROUND OF THE INVENTION

1. Field of the Invention

The present invention relates to the field of low-voltage electric apparatus, more particularly, relates to fault state indication technology of a circuit breaker.

2. The Related Art

In a low-voltage power distribution system, with the development of integration and networking of an electric power system, low-voltage elements with various fault indication functions have become a trend. Whatever for a universal circuit breaker or a miniature circuit breaker, various internal or external accessory devices are provided for increasing an usability of the circuit breaker. Generally, a "fault alarm accessory" or a "fault alarm switch" refers to an accessory device for providing a fault alarm and an indication when a fault occurs in the circuit breaker. The fault accessory device is used to monitor a fault state of the circuit breaker or detect a fault type (under-voltage, over-current, short-circuit and the like) of the circuit breaker), and indicate an alarm indication state caused by the fault of the load circuit, so that an operator may timely discover the fault and take necessary maintenance or replacement. When a fault occurs in the circuit breaker, the fault accessory device provides a fault alarm signal.

According to prior art, a circuit breaker fault indication module for protecting a motor generally includes a state indication accessory and a fault indication accessory which are manufactured in split modules, or formed by simply splicing two separate modules. Both schemes will occupy a large width space. A short-circuit fault indication function is generally realized by a bounced-pressed button structure. When the button is bounced, it means that a short-circuit fault occurs in the load circuit. When the fault is removed and the load circuit works normally, the button is pressed and reset to an initial state. However, misjudgment is easily caused by the recognizing a position difference of the button.

The Chinese patent application with the application number CN20102067548.1, entitled "Accessory device for indicating a fault state of circuit breaker" discloses an accessory device for indicating a fault state of a circuit breaker. The accessory device comprises a shell which is formed by buckling two half shells, wherein an outer side surface of one half shell is tightly attached to one outer side surface of a housing of the circuit breaker. Each of respective driving rods is provided with a linkage rod portion which penetrates through the side surface and is connected with an operation mechanism of the circuit breaker. Two notches are formed at the top of the shell, the driving rod is located right below a transparent cover mounted in one of the notch at the top of the shell. When an over-current fault occurs in the circuit breaker, a colorized indication surface on the driving rod is aligned with the transparent cover of the shell. A colorized indication cap, which is able to extend out of an upper surface of the shell through the other notch is provided on the top of a short-circuit fault indicator. A body of the short-circuit fault indicator is sleeved with a spring. A longitudinal height of the body of the short-circuit fault indicator is compressed by the spring which is caused by an action of the driving rod linked with the operation mechanism. When a short-circuit fault occurs in the circuit breaker, the body of the short-circuit fault indicator is released to the maximum height. The accessory device has a simple design and can save space, the accessory device can not only indicate a fault state of the circuit breaker, but also a fault type. However, a short-circuit fault indication of the an accessory device disclosed in this applicant still uses a bounced-pressed button structure, which is easy to cause misjudgment.

SUMMARY

The present invention provides a new fault state indication device.

According to an embodiment of the present invention, a fault state indication device for a circuit breaker is provided. The fault state indication device comprises a contact group, a transmission assembly and an indication assembly which are mounted inside a housing. The contact group implements a normally open contact group and a normally closed contact group. The transmission assembly acts on a contact support, different open and closed states of the contact group are realized via the contact support. The indication assembly indicates a fault state, the indication assembly is linked with the circuit breaker, and carries out a corresponding state indication in response to a fault.

According to an embodiment, the contact group comprises a first contact group and a second contact group, one of which implements the normally open contact group and the other implements the normally closed contact group.

According to an embodiment, the first contact group comprises a first static contact and a first movable contact, the second contact group comprises a second static contact and a second movable contact. The first static contact and the second static contact are fixed on the housing. The first movable contact and the second movable contact are mounted on the contact support via respective contact bridges, the contact support is able to move within the housing.

According to an embodiment, the contact support moves so that the first contact group and the second contact group implement one of the following states: the first contact group is closed while the second contact group is open, or the first contact group is open while the second contact group is closed.

According to an embodiment, the transmission assembly comprises a transmission lever and a torsion spring. A pushing rod is provided on the contact support, two ends of the pushing rod are respectively connected to the transmission lever and the torsion spring. The transmission assembly acts on the pushing rod so as to drive the contact support to move.

According to an embodiment, the indication assembly comprises a short-circuit fault indication component and an over-current fault indication component. The housing is provided with a short-circuit observation window and an over-current observation window.

According to an embodiment, the short-circuit fault indication component comprises a shifting rod, a shifting rod spring, a blocking rod and a blocking rod spring. The shifting rod is aligned with the short-circuit observation window on the housing, and a first indication region and a second indication region are provided on the shifting rod. When a load circuit of the circuit breaker works normally, the shifting rod spring, the blocking rod and the blocking spring act on the shifting rod, the first indication region of the shifting rod is displayed in the short-circuit observation window. When a short circuit fault occurs in the load circuit of the circuit breaker, the circuit breaker acts on the blocking rod, the shifting rod spring, the blocking rod and the blocking spring act on the shifting rod, then the second indication region of the shifting rod is displayed in the short-circuit observation window.

According to an embodiment, the over-current fault indication component comprises an indication piece with an indication surface. When the load circuit of the circuit breaker works normally, the indication surface is not displayed in the over-current observation window. When an over-current fault occurs in the load circuit of the circuit breaker, the circuit breaker acts on the indication piece, and the indication surface is displayed in the over-current observation window.

According to an embodiment, the housing comprises a base shell and an upper shell, the base shell and the upper shell are combined to form the housing.

The fault state indication device for a circuit breaker has a simple and reliable structure, a manufacturing process which is easier to implement. The fault state indication device can not only indicate the state and type of a load line failure, but also judge an operation state of the circuit breaker via the contact group.

BRIEF DESCRIPTION OF THE DRAWINGS

The above and other features, natures, and advantages of the invention will be apparent by the following description of the embodiments incorporating the drawings, wherein.

DETAILED DESCRIPTION OF EMBODIMENTS

Figure 1:
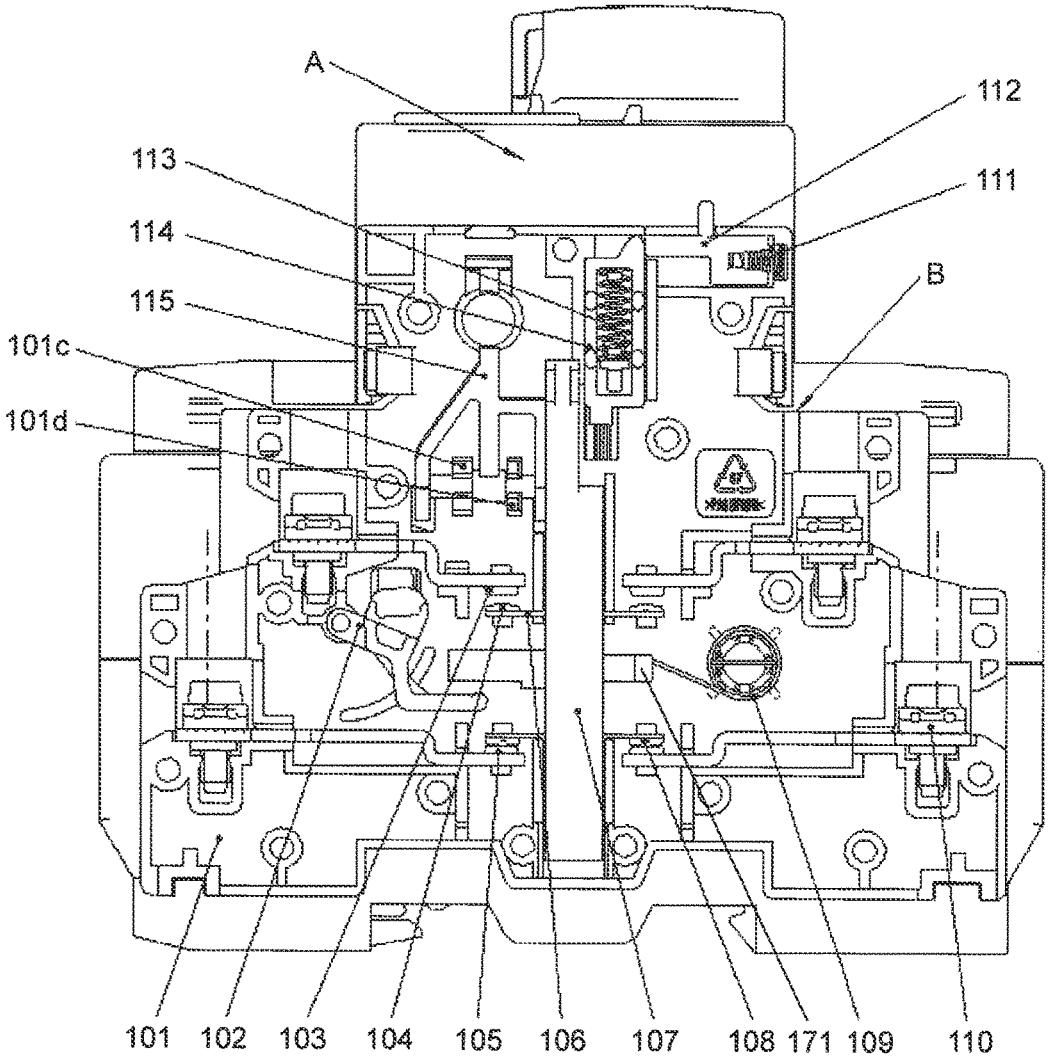
FIG. 1 illustrates a front view structural diagram of a circuit breaker utilizing a fault state indication device according to the present invention.
Figure 2:
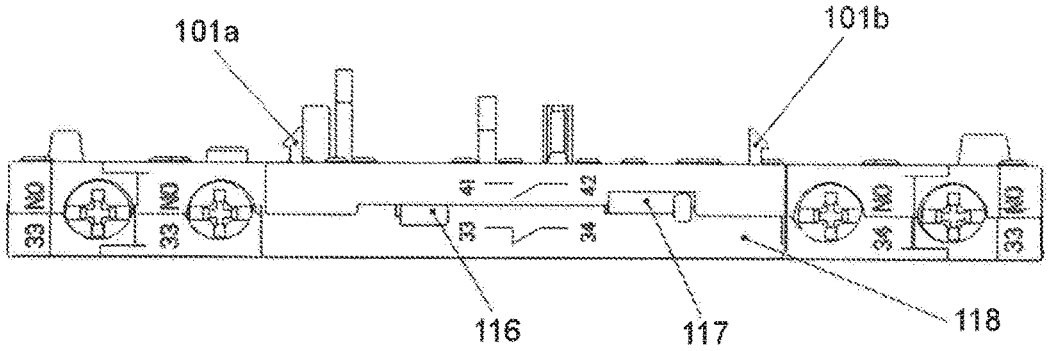
FIG. 2 illustrates a top view structural diagram of a fault state indication device according to the present invention.
Figure 3:
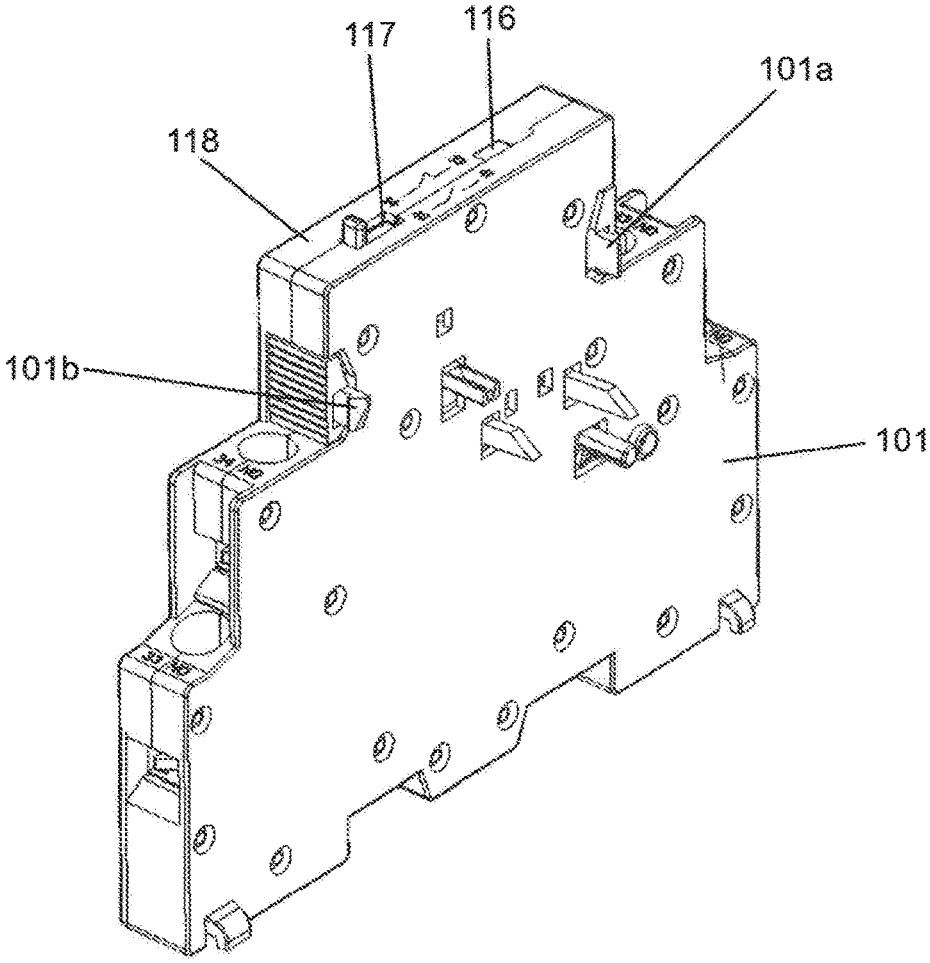
FIG. 3 illustrates a solid view structural diagram of a fault state indication device according to the present invention.

As shown in FIG. 1, FIG. 1 illustrates a front view structural diagram of a circuit breaker utilizing a fault state indication device according to the present invention. According to FIG. 1, the reference "A" refers to a circuit breaker, and the reference "B" refers a fault state indication device. The fault state indication device is mounted on a housing of the circuit breaker. FIG. 2 and FIG. 3 illustrate structural diagrams of the fault state indication device according to the present invention. Wherein FIG. 2 a top view structural diagram while FIG. 3 is a solid view structural diagram. As shown in FIG. 2 and FIG. 3, the housing of the fault state indication device comprises a base shell 101 and an upper shell 118. The base shell 101 and the upper shell 118 are combined to form the housing. Other components of the fault state indication device are disposed within the housing. Connection components are provided on the base shell 101, the connection components enable the housing of the fault state indication device to be connected with a housing of the circuit breaker. According to the illustrated embodiment, the connecting components are barb structures 101*a* and 101*b*. The barb structures 101*a* and 101*b* are clamped on the housing of the circuit breaker, so that the housing of the fault state indication device is connected with the housing of the circuit breaker.

Back to FIG. 1, FIG. 1 also illustrates the structure of the internal components of the fault state indication device. The internal components of the fault state indication, device comprises a contact group, a transmission assembly and an indication assembly. The contact group implements a normally open contact group and a normally closed contact group. The transmission assembly acts on a contact support, different open and closed states of the contact group are realized via the contact support. The indication assembly indicates a fault state, the indication assembly is linked with the circuit breaker, and carries out a corresponding state indication in response to a fault, Two contact groups are provided to implement the normally open contact group and the normally closed contact group respectively. A first contact group in the two contact groups comprises a first static contact 103 and a first movable contact 104. A second contact group in the two contact groups comprises a second static contact 105 and a second movable contact 108. One of the first contact group and the second contact group implements the normally open contact group, while the other implements the normally closed contact group. The first static contact 103 and the second static contact 105 are both formed by riveting a contact plate with a silver-based contact. The first static contact 103 and the second static contact 105 are fixed in a groove in the base shell 101. Continue with FIG. 1, the first static contact 103 and the second static contact 105 are connected to respective combined screws 110 respectively. The combined screws 110 are used for external wiring, so as to realize external wiring for a normally open contact point and a normally close contact point. The first movable contact 104 and the second movable contact 108 are mounted on a contact support 107 via respective contact bridges 106. The first movable contact 104 and the second movable contact 108 are both formed by riveting silver-based contacts on respective contact bridges 106. The contact support 107 is able to move within the base shell 101. According to the embodiment shown in FIG. 1, the contact support 107 is disposed in a longitudinal groove in the base shell 101 and can move in the longitudinal groove. The first movable contact 104 and the second movable contact 108 are respectively mounted on an upper portion and a lower portion of the contact support 107, and are corresponding to positions of the first static contact 103 and the second static contact 105 respectively. When the contact support 107 moves longitudinally, the first contact group and the second contact group implement one of the following three states: the first contact group is closed while the second contact group is open, or the first contact group is open while the second contact group is closed, or both the first contact group and the second contact group are open. Wherein the following two states are stable states: the first contact group is closed while the second contact group is open, or the first contact group is open while the second contact group is closed, and the state of both the first contact group and the second contact group being open is a transient state. In practical application, with the movement of the contact support 107, it switches between the two stable states, which are the state of the first contact group being closed while the second contact group being open, and the state of the first contact group being open while the second contact group being closed. So that closing and opening of the normally open contacts and the normally close contacts can be realized, and fault signals can be outputted. When both the first contact group and the second contact group are open, and it is not able to restore to the stable states, that is the state of the first contact group being closed while the second contact group being open, or the state of the first contact group being open while the second contact group being closed. It means that a fault occurs in the transmission assembly. The fault state indication device will display an intermediate state indication to inform troubleshooting or accessory replacement.

The transmission assembly comprises a transmission lever 102 and a torsion spring 109. The transmission lever 102 and the torsion spring 109 are used to drive the contact support 107 to move. The transmission lever 102 is mounted on the housing through a shaft, two ends of the shaft are mounted on the base shell 101 and the upper shell 118 respectively, the transmission lever 102 rotates about the shaft 102. The contact support 107 is provided with a pushing rod 171 which is arranged transversely (according to FIG. 1, the pushing rod 171 is transverse while the contact support 107 is longitudinal). A first end of the pushing rod 171 is disposed close to the transmission lever 102. When the transmission lever 102 rotates about the shaft, the transmission lever 102 is in contact with the first end of the pushing rod 171 and drives the contact support 107 to move longitudinally via the pushing rod 171. A second end of the pushing rod 171 is connected to the torsion spring 109. The torsion spring 109 is mounted on an annular support on the base shell 101, and the annular support is disposed close to the second end of the pushing rod 171. The torsion spring 109 is connected to the second end of the pushing rod 171. The torsion spring 109 applies a reset force to the pushing rod 171 to drive the contact support 107 to reset. The transmission lever 102 and the torsion spring 109 act together so as to enable the contact support 107 to reciprocate longitudinally. According to the illustrated embodiment, the spring force provided by the torsion spring 109 enables the contact support 107 to have a downward movement tendency, so that the second contact group composed of the second static contact 105 and the second movable contact 108 is closed. When the transmission lever 102 is driven by an external force to rotate upwards, it pushes the first end of the pushing rod 171 to move upwards, and the contact support 107 is driven to move upwards, so that the second contact group is open. As the transmission lever 102 continues to rotate, it pushes the pushing rod 171 and the contact support 107 to move upwards continuously, so that the first contact group composed of the first static contact 103 and the first movable contact 104 is closed. Accordingly, when the external force which drives the transmission lever 102 disappears, the pushing rod 171 will drive the contact support 107 to return to the downward movement tendency under the action of the torsion spring 109.

Figure 4:
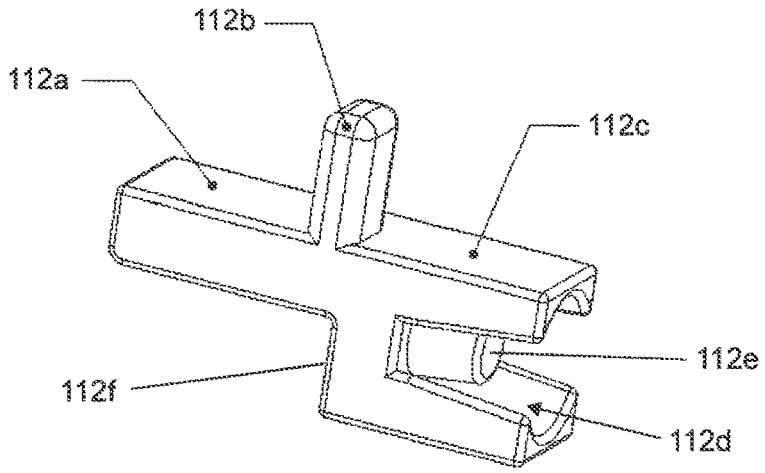
FIG. 4 illustrates a structural diagram of a shifting rod of a fault state indication device according to the present invention.

The indication assembly comprises a short-circuit fault indication component and an over-current fault indication component. The short-circuit fault indication component comprises a shifting rod 112, a shifting rod spring 111, a blocking rod 113 and a blocking rod spring 114. The short-circuit fault indication component is arranged at the top of the housing composed of the base shell 101 and the upper shell 108. As shown in FIG. 1, a transverse groove (according to FIG. 1, the groove is transverse) is provided at the top of the housing. The shifting rod 112 is arranged in the groove, and the shifting rod 112 can slide in the groove. The shifting rod spring 111 is installed on the shifting rod 112. One end of the shifting rod spring 111 abuts the shifting rod 112, and the other end of the shifting rod spring 111 abuts on a side wall of the housing. FIG. 4 illustrates a structural diagram of a shifting rod of a fault state indication device according to the present invention. As shown in FIG. 4, a protruding handle 112*b* is provided on the top of the shifting rod 112. A first indication region 112*a* and a second indication region 112*c* are provided on respective sides of the protruding handle 112*b*. According to an embodiment, the first indication region 112*a* and the second indication region 112*c* have different identifications, such as different colors. As shown in FIG. 2 and FIG. 3, the position of the shifting rod 112 is corresponding to the position of a short-circuit observation window 117 on the housing. As shown in FIG. 4, a spring accommodation cavity 112*d* is provided at a second end of the shifting rod 112, a sleeve rod 112*e* is arranged in the spring accommodation cavity 112*d*, and the shifting rod spring 111 is located in the spring accommodation cavity 112*d* and is sleeved on the sleeve rod 112*e*. A step structure 112*f* is formed at the bottom of the shifting rod 112. Back to FIG. 1, the short-circuit fault indication component further comprises a blocking rod 113 and a blocking rod spring 114. The blocking rod 113 is located in a longitudinal groove in the base shell 101 and can move along the longitudinal groove, the blocking rod spring 114 is disposed in the blocking rod 113 and applies a spring force to the blocking rod 113. As shown in FIG. 1, when a load circuit of the circuit breaker works normally, the spring force applied to the blocking rod 113 by the blocking rod spring 114 enables the blocking rod 113 to form an upward moving tendency. The blocking rod 113 abuts on an end surface of the first end of the shifting rod 112, and presses the shifting rod 112 to the right side (According to FIG. 1, the shifting rod 112 is pressed to the right side). At the moment, the shifting rod spring 111 is in a compressed energy storage state. As shown in FIG. 2 and FIG. 3, the handle 112*b* on the shifting rod 112 is in contact with one end of the short-circuit observation window 117 and the position of the handle 112*b* is limited. The first indication region 112*a* on the shifting rod 112 can be observed through the short-circuit observation window 117. When a short circuit fault occurs in the load circuit of the circuit breaker, the circuit breaker will carry out a short-circuit breaking operation by adopting corresponding actions. The circuit breaker will act on the blocking rod 113 at the same time, an action force which is provided by the circuit breaker and applies to the blocking rod 113 overcomes the spring force of the blocking rod spring 114, so that the blocking rod 113 moves downwards. When the blocking rod 113 moves downwards, the stopping rod 113 no longer abuts on the end surface of the first end of the shifting rod 112. The shifting rod 112 moves leftwards (according to FIG. 1, the shifting rod 112 moves leftwards) under the action of the shifting rod spring 111 until the step structure 112*f* on the shifting rod 112 is blocked by the blocking rod 113. At this time, the handle 112*b* on the shift rod 112 is in contact with the other end of the short-circuit observation window 117 and the position of the handle 112*b* is limited. A second indication region 112*c* on the shift rod 112 can be observed through the short-circuit observation window 117, so as to indicate a different state with that indicated by the first indication region 112*a*. According to this embodiment, the first indication region 112*a* indicates normal operation while the second indication region 112*c* indicates a short circuit fault.

Figure 5:
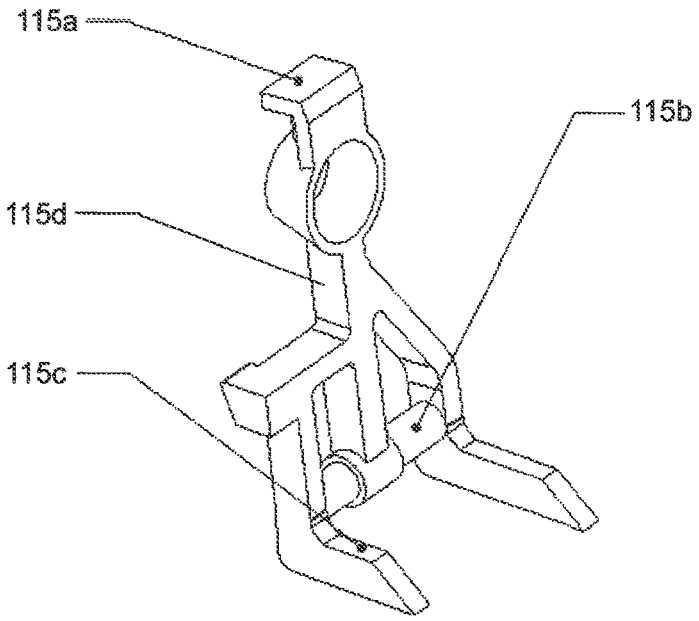
FIG. 5 illustrates a structural diagram of a driving rod of a fault state indication device according to the present invention.

The over-current fault indication component comprises an indication piece 115. FIG. 5 illustrates a structural diagram of a driving rod of a fault state indication device according to the present invention. As shown in FIG. 5, the indication piece 115 comprises a body 115*d*, an indication surface 115*a* located at the top of the body 115*d*, a rotation shaft 115*b* located at the bottom of the body 115*d*, and an extension rod 115*c* extending outwards from the body 115*d*. It should be noted that according to FIG. 5, the body 115*d* is illustrated to have a certain shape, for example, a circular ring is provided on an upper portion, a plurality of columnar structures are formed in a middle portion etc. However, the specific shape of the body 115*d* is not important to the present invention. According to the present invention, the functions are realized by the indication surface 115*a*, the rotation shaft 115*b* and the extension rod 115*c*. Back to FIG. 1, two C-shaped supports 101*c* and 101*d* are arranged on the base shell 101, the rotation shaft 115*b* of the indication piece 115 is installed on the supports 101*c* and 101*d*. According to the embodiment shown in FIG. 1, indication piece 115 rotates in a plane perpendicular to the paper surface, that is, the indication piece 115 rotates towards an inner side or an outer side of the paper surface. As shown in FIG. 2 and FIG. 3, when the load circuit of the circuit breaker works normally, the indication piece 115 is located at an initial position. At the initial position, the indication surface 115*a* of the indication piece 115 is not aligned with the over-current observation window 116 on the housing, and the indication surface 115*a* cannot be observed through the over-current observation window 116. When an over-current fault occurs in the load circuit of the circuit breaker, the circuit breaker will carry out an over-current breaking operation by, adopting corresponding actions. The circuit breaker will act on the extension rod 115*c* of the indication piece 115 at the same time, so that the indication piece 115 will rotate about the rotation shaft 115*b* to a fault position. At the fault position, the indication surface 115*a* of the indication piece 115 is aligned with the over-current observation window 116 on the housing, and the indication surface 115*a* can be observed through the over-current observation window 116.

Based on the above description, when the load circuit of the circuit breaker works normally, the fault state indication device of the invention does not provide any fault alarm indication on an over-current fault or a short-circuit fault, and the first indication region 112*a* which indicates normal operation is observed through the short-circuit observation window 117. When an over-current fault occurs, the indication surface 115*a* which indicates the existence of an over-current fault is observed through the over-current observation window 116. When a short-circuit fault occurs, the second indication region 112*c* which indicates the existence of a short-circuit fault is observed through the short-circuit observation window 117.

The fault state indication device for a circuit breaker has a simple and reliable structure, a manufacturing process which is easier to implement. The fault state indication device can not only indicate the state and type of a load line failure, but also judge an operation state of the circuit breaker via the contact group.

The above embodiments are provided to those skilled in the art to realize or use the invention, under the condition that various modifications or changes being made by those skilled in the art without departing the spirit and principle of the invention, the above embodiments may be modified and changed variously, therefore the protection scope of the invention is not limited by the above embodiments, rather, it should conform to the maximum scope of the innovative features mentioned in the Claims.

What is claimed is:

1. A fault state indication device for a circuit breaker, comprising:

a contact group; and a transmission assembly and an indication assembly that are mounted inside a housing, wherein the contact group implements a normally open contact group and a normally closed contact group, the transmission assembly acts on a contact support, different open and closed states of the contact group are realized via the contact support, the indication assembly indicates a fault state, the indication assembly is linked with the circuit breaker, and carries out a corresponding state indication in response to a fault, the indication assembly comprises a short-circuit fault indication component and an over-current fault indication component, the housing is provided with a short-circuit observation window and an over-current observation window, the short-circuit fault indication component comprises a shifting rod, a shifting rod spring, a blocking rod and a blocking rod spring, the shifting rod is aligned with the short-circuit observation window on the housing, and a first indication region and a second indication region are provided on the shifting rod, when a load circuit of the circuit breaker works normally, the shifting rod spring, the blocking rod and the blocking spring act on the shifting rod, the first indication region of the shifting rod is displayed in the short-circuit observation window, and when a short circuit fault occurs in the load circuit of the circuit breaker, the circuit breaker acts on the blocking rod, the shifting rod spring, the blocking rod and the blocking spring act on the shifting rod, then the second indication region of the shifting rod is displayed in the short-circuit observation window.

2. The fault state indication device for a circuit breaker according to claim 1, wherein the contact group comprises a first contact group and a second contact group, one of which implements the normally open contact group and the other implements the normally closed contact group.

3. The fault state indication device for a circuit breaker according to claim 2, wherein the first contact group comprises a first static contact and a first movable contact, the second contact group comprises a second static contact and a second movable contact;

the first static contact and the second static contact are fixed on the housing;

the first movable contact and the second movable contact are mounted on the contact support via respective contact bridges, the contact support is able to move within the housing.

4. The fault state indication device for a circuit breaker according to claim 3, wherein the contact support moves so that the first contact group and the second contact group implement one of the following states: the first contact group is closed while the second contact group is open, or the first contact group is open while the second contact group is closed.

5. The fault state indication device for a circuit breaker according to claim 1, wherein the transmission assembly comprises a transmission lever and a torsion spring;

a pushing rod is provided on the contact support, two ends of the pushing rod are respectively connected to the transmission lever and the torsion spring;

the transmission assembly acts on the pushing rod so as to drive the contact support to move.

6. The fault state indication device for a circuit breaker according to claim 1, wherein the over-current fault indication component comprises an indication piece with an indication surface;

when the load circuit of the circuit breaker works normally, the indication surface is not displayed in the over-current observation window;

when an over-current fault occurs in the load circuit of the circuit breaker, the circuit breaker acts on the indication piece, and the indication surface is displayed in the over-current observation window.

7. The fault state indication device for a circuit breaker according to claim 1, wherein the housing comprises a base shell and an upper shell, the base shell and the upper shell are combined to form the housing.

* * * * *